US007074118B1

(12) United States Patent
Bottema et al.

(10) Patent No.: US 7,074,118 B1
(45) Date of Patent: Jul. 11, 2006

(54) POLISHING CARRIER HEAD WITH A MODIFIED PRESSURE PROFILE

(75) Inventors: Brian E. Bottema, Austin, TX (US); Keven A. Cline, Austin, TX (US); Alex P. Pamatat, Grenoble (FR); Nathan R. Brown, Cedar Park, TX (US)

(73) Assignee: Freescale Semiconductor, Inc., Austin, TX (US)

( * ) Notice: Subject to any disclaimer, the term of this patent is extended or adjusted under 35 U.S.C. 154(b) by 0 days.

(21) Appl. No.: 11/264,185

(22) Filed: Nov. 1, 2005

(51) Int. Cl.
*B24B 5/00* (2006.01)

(52) U.S. Cl. ..... 451/285; 451/288; 451/398

(58) Field of Classification Search ..... 451/41, 451/285, 287, 288, 397, 398, 402
See application file for complete search history.

(56) References Cited

U.S. PATENT DOCUMENTS 6,132,298 A * 10/2000 Zuniga et al. ..... 451/288
6,227,955 B1 5/2001 Custer et al.
6,244,942 B1 6/2001 Zuniga
6,890,249 B1 * 5/2005 Zuniga et al. ..... 451/398
6,984,168 B1 * 1/2006 Melvin et al. ..... 451/285
2004/0029503 A1 * 2/2004 Kajiwara et al. ..... 451/288
2004/0266324 A1 * 12/2004 Bottema et al. ..... 451/285
2005/0142995 A1 * 6/2005 Perlov et al. ..... 451/402
2005/0215182 A1 * 9/2005 Fuhriman et al. ..... 451/41

* cited by examiner

*Primary Examiner*—Eileen P. Morgan
(74) *Attorney, Agent, or Firm*—Robert L. King; Ranjeev Singh

(57) ABSTRACT

A polishing carrier head including a retaining ring for defining an area of a polishing pocket region used to polish a predetermined object, is provided. The polishing carrier head may further include a perforated plate positioned lateral to the retaining ring, the perforated plate having a plurality of perforations for permitting fluid flow. The polishing carrier head may further include a flexible membrane having a first region overlying a portion of the retaining ring and the perforated plate and a second region in which a first portion of the flexible membrane overlies a second portion of the flexible membrane to form one or more bellows. The polishing carrier head may further include an edge support ring in contact with the first region of the flexible membrane for clamping the first region of the flexible membrane to the perforated plate.

20 Claims, 5 Drawing Sheets

POLISHING CARRIER HEAD WITH A MODIFIED PRESSURE PROFILE

FIELD OF THE INVENTION

The present invention relates generally to equipment for use in chemical mechanical polishing, and more particularly to a polishing carrier head with a modified pressure profile.

RELATED ART

Traditional polishing carrier heads used in chemical mechanical polishing result in non-uniform pressure being applied to a substrate during polishing. The application of non-uniform pressure results in non-uniform polishing of the substrate. Conventionally, to ameliorate this problem, polishing carrier heads have been modified by including an edge control ring with a floating design. Such edge control rings, however, do not provide sufficient pressure to the edge of the substrate resulting in application of non-uniform pressure to the substrate. Additionally or alternatively, edge rate tabs have been added as well, in an attempt to address this problem. Edge rate tabs, however, have resulted in an undesirably high polish rate near the edge of the substrate, but have not resulted in a desirable increase in polish rate at the edge of the substrate.

Thus, there is a need for an improved polishing carrier head for use in chemical mechanical polishing.

BRIEF DESCRIPTION OF THE DRAWINGS

The present invention is illustrated by way of example and not limited by the accompanying figures, in which like references indicate similar elements, and in which.

Figure 1:
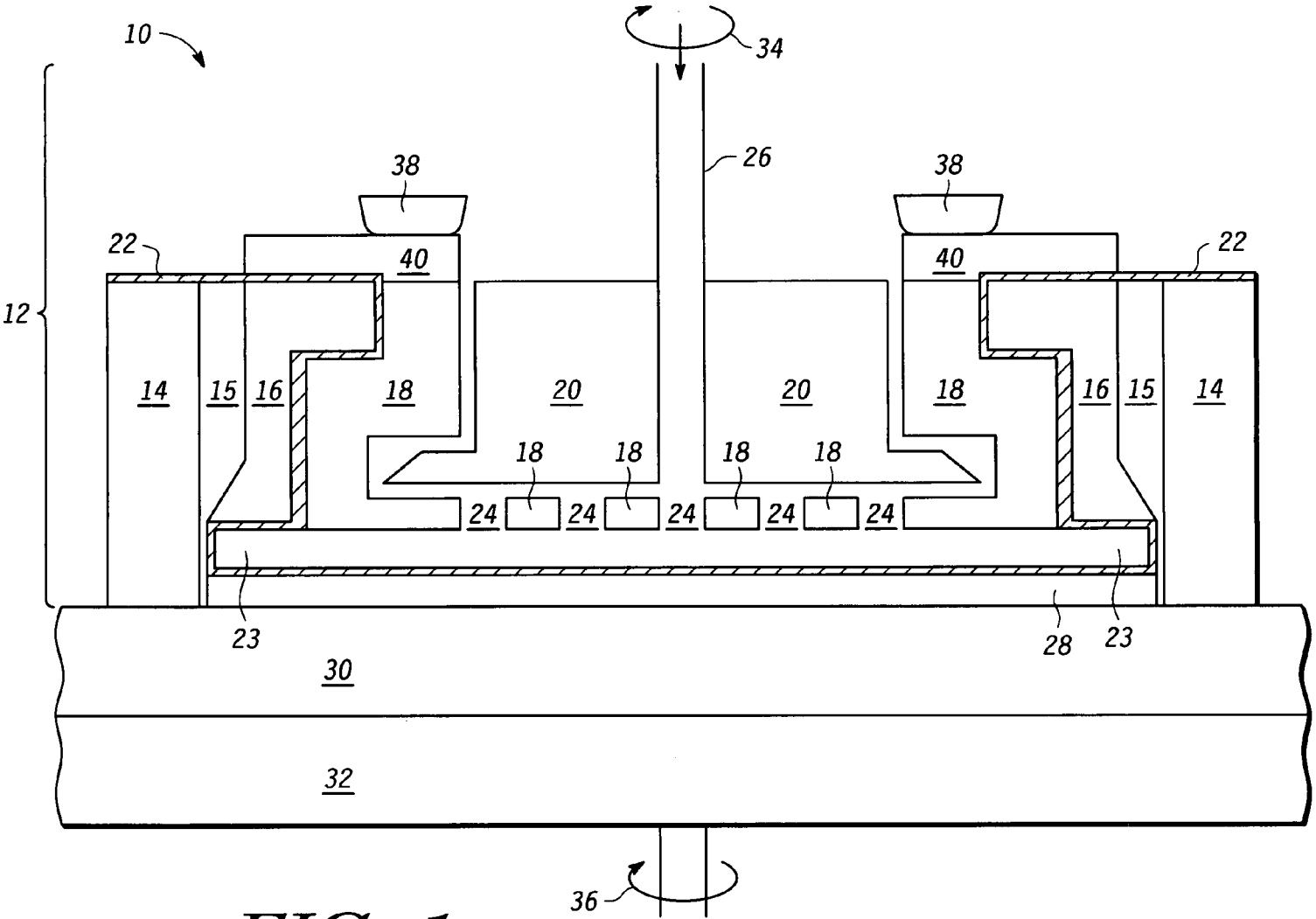
FIG. 1 is a cross section view of a polishing head assembly with an edge support ring, consistent with one embodiment of the invention.

Skilled artisans appreciate that elements in the figures are illustrated for simplicity and clarity and have not necessarily been drawn to scale. For example, the dimensions of some of the elements in the figures may be exaggerated relative to other elements to help improve the understanding of the embodiments of the present invention.

DETAILED DESCRIPTION OF THE EMBODIMENTS

In one aspect, a polishing carrier head, including a retaining ring for defining an area of a polishing pocket region used to polish a predetermined object is provided. The retaining ring may dampen external oscillatory energy. The polishing carrier head may further include an edge control ring positioned lateral to the retaining edge and separated from the retaining ring by a gap. The polishing carrier head may further include a perforated plate positioned lateral to the edge control ring, where the perforated plate may have a plurality of perforations for permitting fluid flow. The polishing carrier head may further include a flexible membrane overlying a portion of the retaining ring, where the edge control ring may extend between the edge control ring and the perforated plate. A first portion of the flexible membrane may overly a second portion of the flexible membrane under the edge control ring to form a flab region, the flexible membrane being exposed in a region to make contact to a predetermined object for polishing the predetermined object. The edge support ring may be in contact with a third portion of the flexible membrane overlying the edge control ring and rigidly coupled to the perforated plate, the edge support ring constraining motion of the edge control ring relative to the predetermined object. The polishing carrier head may further include a plate region overlying the plurality of perforations of the perforated plate for conducting fluid to and from the flexible membrane and restricting vertical motion of the perforated plate and flexible membrane.

In another aspect, a polishing carrier head, including a retaining ring for defining an area of a polishing pocket region used to polish a predetermined object, the retaining ring dampening external oscillatory energy, is provided. The polishing carrier head may further include an edge control ring positioned lateral to the retaining ring and separated from the retaining ring by a gap. The polishing carrier head may further include a perforated plate positioned lateral to the edge control ring, the perforated plate having a plurality of perforations for permitting fluid flow. The polishing carrier head may further include a flexible membrane overlying a portion of the retaining ring and the edge control ring and extends to a region in which a first portion of the flexible membrane overlies a second portion of the flexible membrane to form one or more bellows, the flexible membrane being exposed along a length thereof to make contact to a predetermined object for polishing the predetermined object. The polishing carrier head may further include an edge support ring in contact with a third portion of the flexible membrane overlying the edge control ring and rigidly coupled to the perforated plate, the edge support ring constraining motion of the edge control ring relative to the predetermined object. The polishing carrier head may further include a plate region overlying the plurality of perforations of the perforated plate for conducting fluid to and from the flexible membrane and restricting vertical motion of the perforated plate and flexible membrane.

In yet another aspect, a polishing carrier head including a retaining ring for defining an area of a polishing pocket region used to polish a predetermined object, the retaining ring dampening external oscillatory energy, is provided. The polishing carrier head may further include a perforated plate positioned lateral to the retaining ring, the perforated plate having a plurality of perforations for permitting fluid flow. The polishing carrier head may further include a flexible membrane having a first region overlying a portion of the retaining ring and the perforated plate and to a second region in which a first portion of the flexible membrane overlies a second portion of the flexible membrane to form one or more bellows, the flexible membrane being exposed along a length thereof to make contact to a predetermined object for polishing the predetermined object. The polishing carrier head may further include an edge support ring in contact with the first region of the flexible membrane for clamping the first region of the flexible membrane to the perforated plate. The polishing carrier head may further include a plate region overlying the plurality of perforations of the perforated plate for conducting fluid to and from the flexible membrane and restricting vertical motion of the perforated plate and flexible membrane.

A polishing head assembly 10 may be used to polish an object, such as a substrate as part of a chemical mechanical polishing process. FIG. 1 is a cross section view of polishing head assembly 10 with an edge support ring 40, consistent with one embodiment of the invention. Polishing head assembly 10 may include a carrier head 12 that may polish a substrate 28. Carrier head 12 may be rotated 34 using any suitable rotation mechanism. Carrier head 12 may hold substrate 28 in contact with a polishing surface 30. Polishing surface 30 may be attached to a platen 32, which may be rotated 36 using any suitable rotation mechanism. Frictional contact between substrate 28 and polishing surface 30 would result in substrate 28 being polished. Although not shown in FIG. 1, any suitable polishing media may be used at the interface of substrate 28 and polishing surface 30, as part of the polishing process.

Carrier head 12 may include a retaining ring 14, which may be used to keep substrate 28 in a polishing pocket region defined by retaining ring 14. Carrier head 12 may further include an active flab membrane 22, which when inflated using fluid, for example, may provide a downward pressure onto substrate 28. Carrier head 12 may further include a perforated plate 18, which may provide support to active flab membrane 22. Perforated plate 18 may include perforations 24, which may provide a passage for the fluid into active flab membrane 22. Perforated plate 18 may be coated with a Teflon impregnated coating. Carrier head 12 may further include an edge control ring 16 separated by a gap 15 from retaining ring 14. Edge control ring may provide additional support to active flab membrane 22. Carrier head 12 may further include a gimbal plate 20, which may have a fluid shaft 26 to provide fluid pressure to an inside surface of active flab membrane 22.

Fluid pressure on active flab membrane 22 may result in a corresponding pressure on substrate 28 against polishing surface 30. Upward movement of edge control ring 16 may be prevented using an edge support ring 40, which may function as a clamp. Thus, in the absence of edge support ring 40, edge control ring 16 may move upward because of pressure applied upwards by flab region 23. Carrier head 12 may further include an inner tube bladder 38, which may be used to provide additional pressure on the edges of substrate 28. Carrier head 12 may include additional and/or fewer components. Additionally, although FIG. 1 shows a gap 15 having a particular shape and size between retaining ring 14 and edge control ring 16, gap 15 may be substantially filled by using a differently shaped edge control ring 16, for example.

Figure 2:
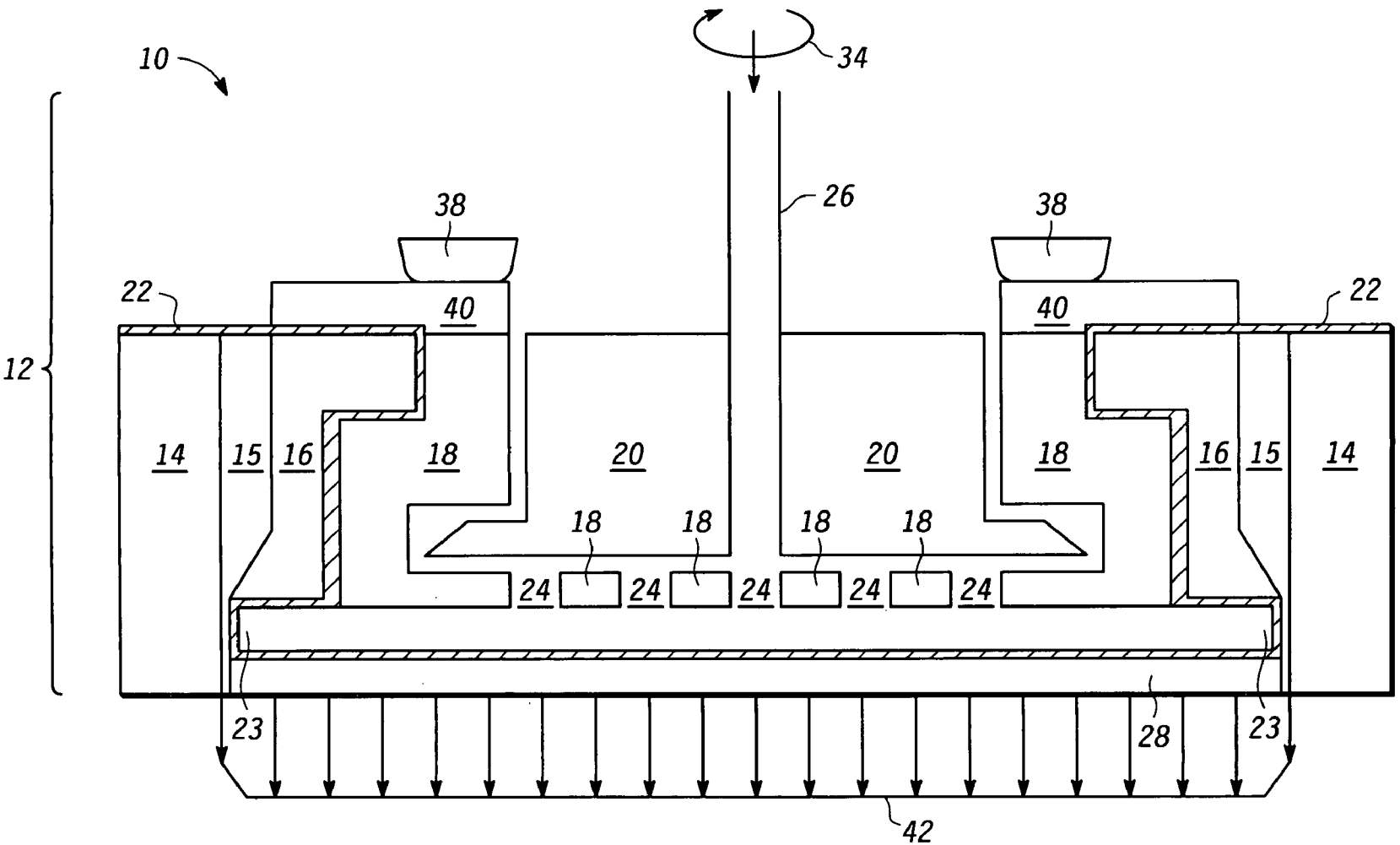
FIG. 2 is a cross section view of a polishing head assembly with a pressure profile corresponding to a carrier head of the polishing head assembly, consistent with one embodiment of the invention.

FIG. 2 is a cross section view of a polishing head assembly with a pressure profile 42 corresponding to a carrier head 12 of polishing head assembly 10, consistent with one embodiment of the invention. As shown in FIG. 2, pressure profile 42 may be made more uniform using a combination of edge control ring 16 and edge support ring 40. Although FIG. 2 shows a specific pressure profile, other pressure profiles may be achieved using other configurations of edge control ring 16 and edge support ring 40. Use of a uniform pressure profile may result in a uniform removal rate. A uniform removal rate may result in, for example, in uniform metal interconnect sheet resistance following polishing. Furthermore, uniform metal interconnect sheet resistance may result in an increased product yield. Other benefits of using a desired pressure profile include, but are not limited to, improved metrics, such as speed, reliability, and transistor drive current etc.

Figure 3:
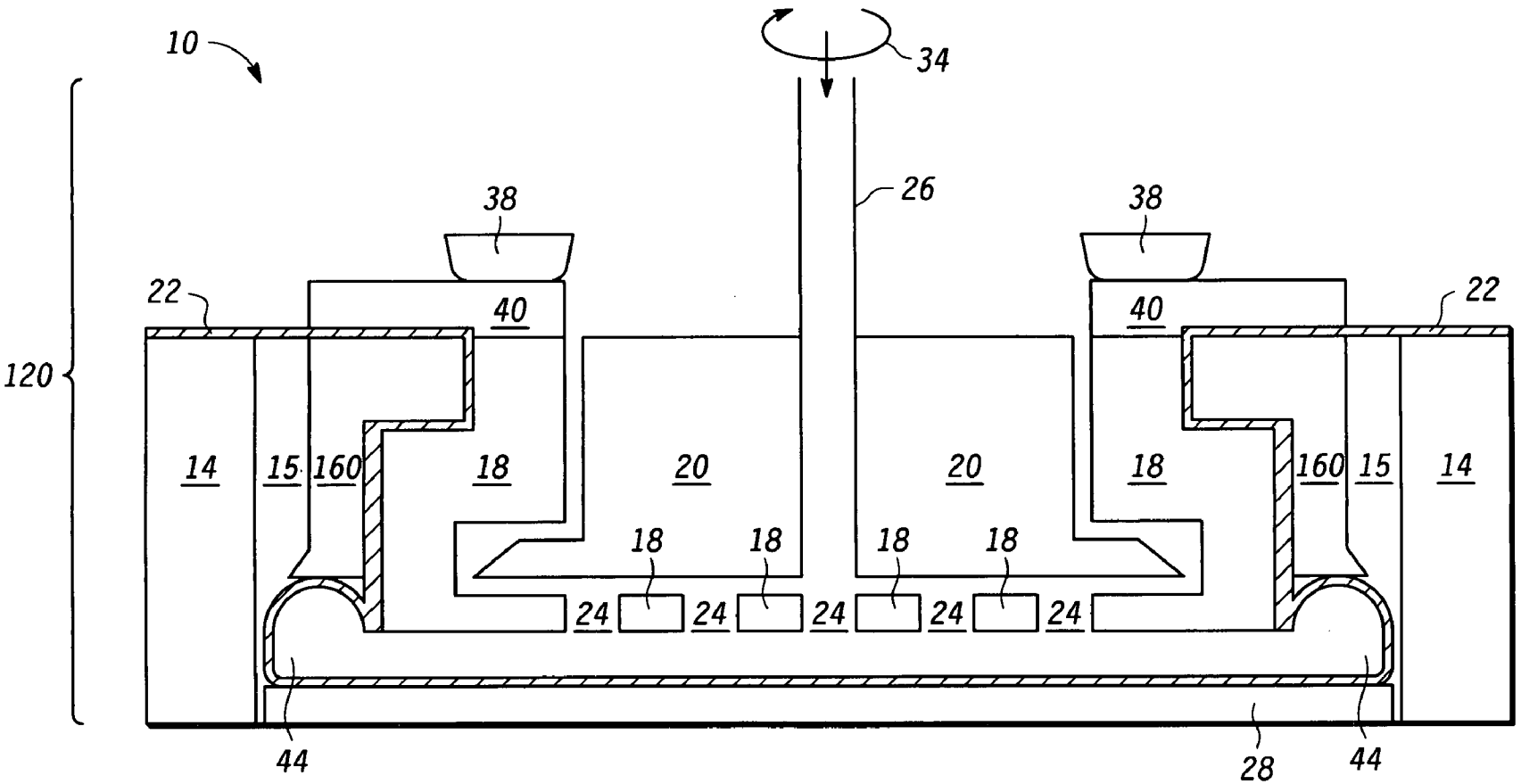
FIG. 3 is a cross section view of a polishing head assembly with a recessed edge control ring, consistent with one embodiment of the invention.

FIG. 3 is a cross section view of polishing head assembly 10 with a recessed edge control ring 160, consistent with one embodiment of the invention. Polishing head assembly 10 may include similar components, as illustrated with respect to FIG. 1, except it may include a carrier head 120 with a modified pressure profile. In this exemplary embodiment of carrier head 120, the pressure profile of carrier head 120 may be modified using a recessed edge control ring 160. Recessed edge control ring 160 may result in an inflated active flab area 44 in the increased space created by recessed edge control ring 160. This in turn may result in a reduced pressure along the edges of substrate 28. Reduced pressure along the edges of substrate 28 may be useful in polishing a substrate with thin edge film thickness to provide for a planar surface of the polished substrate. A planar surface may result in, for example, in uniform metal interconnect sheet resistance following polishing. Furthermore, uniform metal interconnect sheet resistance may result in an increased product yield. Although FIG. 3 shows a gap 15 having a particular shape and size between retaining ring 14 and edge control ring 160, gap 15 may be substantially filled by using a differently shaped edge control ring 160, for example.

Figure 4:
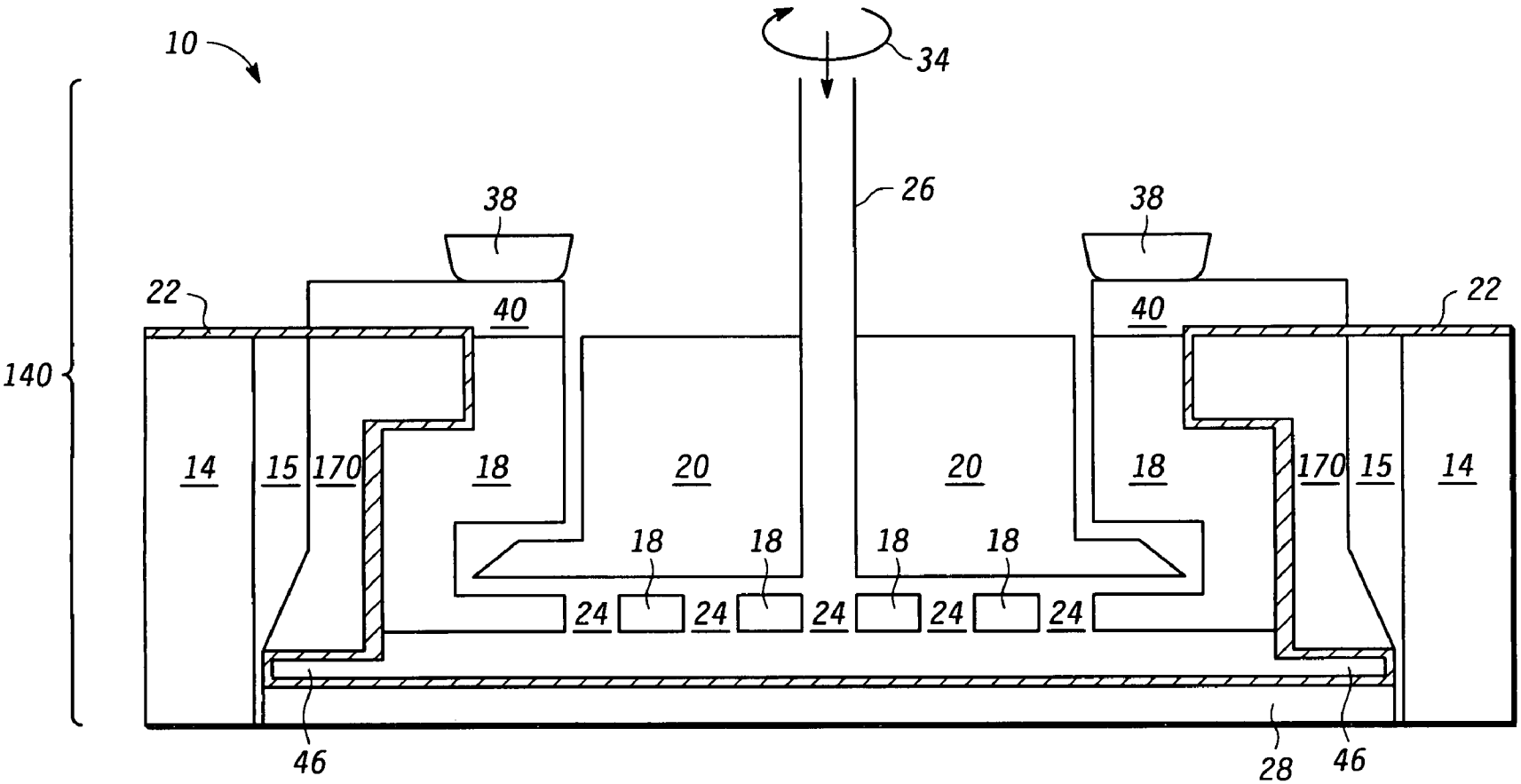
FIG. 4 is a cross section view of a polishing head assembly with an extended edge control ring, consistent with one embodiment of the invention.

FIG. 4 is a cross section view of a polishing head assembly 10 with an extended edge control ring 170, consistent with one embodiment of the invention. Polishing head assembly 10 may include similar components, as illustrated with respect to FIG. 1, except it may include a carrier head 140 with a modified pressure profile. In this exemplary embodiment of carrier head 140, the pressure profile of carrier head 140 may be modified using an extended edge control ring 170. Extended edge control ring 170 may result in a compressed active flab area 46 in the reduced space created by extended edge control ring 170. This in turn may result in an increased pressure along the edges of substrate 28. Increased pressure along the edges of substrate 28 may be useful in polishing a substrate with thick edge film thickness to provide for a planar surface of the polished substrate. A planar surface may result in, for example, in uniform metal interconnect sheet resistance following polishing. Furthermore, uniform metal interconnect sheet resistance may result in an increased product yield. Although FIG. 4 shows a gap 15 having a particular shape and size between retaining ring 14 and edge control ring 170, gap 15 may be substantially filled by using a differently shaped edge control ring 170, for example.

Figure 5:
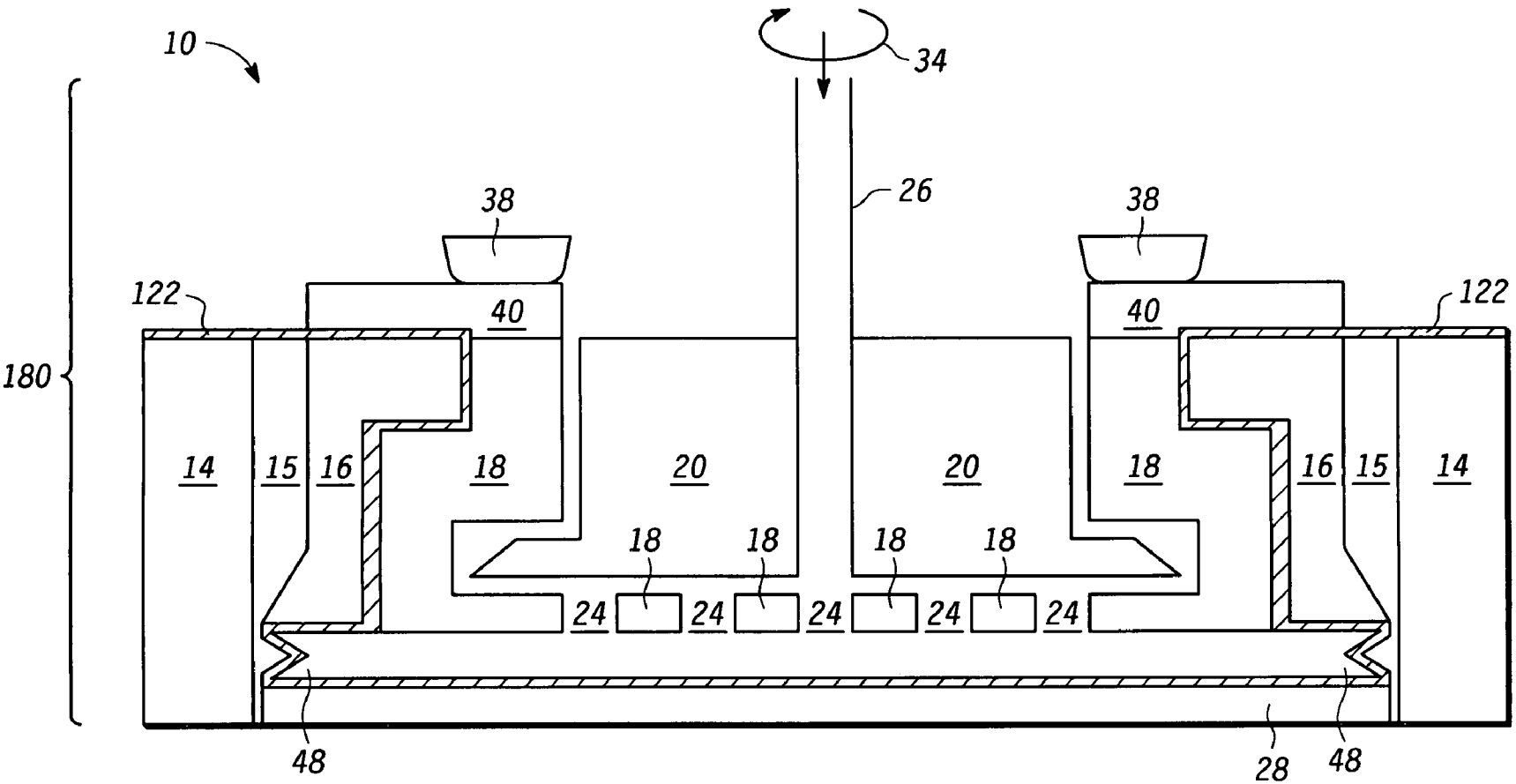
FIG. 5 is a cross section view of a polishing head assembly with an edge support ring and a bellowed membrane, consistent with one embodiment of the invention.

FIG. 5 is a cross section view of a polishing head assembly with an edge control ring and a bellowed membrane 122, consistent with one embodiment of the invention. Polishing head assembly 10 may include similar components, as illustrated with respect to FIG. 1, except it may include a carrier head 180 with a modified pressure profile. In this exemplary embodiment of carrier head 180, the pressure profile of carrier head 180 may be modified using a bellowed membrane 122. Although bellowed membrane 122 is shown in FIG. 5 with one fold forming a bellowed region 48, bellowed membrane 122 may include additional folds. Bellowed membrane 122 may result in an increased pressure applied to the edges of substrate 28 for the same given fluid pressure. Although not shown, bellowed membrane 122 may be used in conjunction with recessed edge control ring 160 and/or extended edge control ring 170 to achieve desirable pressure profiles. Additionally, although FIG. 5 shows a gap 15 having a particular shape and size between retaining ring 14 and edge control ring 16, gap 15 may be substantially filled by using a differently shaped edge control ring 16, for example. Furthermore, although FIG. 5 shows bellowed membrane 122 extending to an interface between edge control ring 16 and perforated plate 18, bellowed membrane 122 may be terminated prior to extending up to the top of retaining ring 14 using a clamp ring or any other suitable technique, for example. For example, bellowed membrane 122 may be terminated prior to extending between edge control ring 16 and perforated plate 18. In addition, although FIG. 5 shows a separate edge control ring 16 and a separate perforated plate 18, edge control ring 16 may be formed as part of perforated plate 18. Thus, by way of example, carrier head 180 may not include an edge control ring 16. Edge support ring 40 may further clamp a different portion of bellowed membrane 122.

In the foregoing specification, the invention has been described with reference to specific embodiments. However, one of ordinary skill in the art appreciates that various modifications and changes can be made without departing from the scope of the present invention as set forth in the claims below. For example, although retaining ring 14 is identified as being used for dampening external oscillatory energy, edge control ring 16 may also be used to dampen external oscillatory energy. Accordingly, the specification and figures are to be regarded in an illustrative rather than a restrictive sense, and all such modifications are intended to be included within the scope of present invention.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims. As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A polishing carrier head comprising:

a retaining ring for defining an area of a polishing pocket region used to polish a predetermined object, the retaining ring dampening external oscillatory energy;

an edge control ring positioned lateral to the retaining ring and separated from the retaining ring by a gap;

a perforated plate positioned lateral to the edge control ring, the perforated plate having a plurality of perforations for permitting fluid flow;

a flexible membrane overlying a portion of the retaining ring, the edge control ring and extends between the edge control ring and the perforated plate, a first portion of the flexible membrane overlying a second portion of the flexible membrane under the edge control ring to form a flab region, the flexible membrane being exposed in a region to make contact to a predetermined object for polishing the predetermined object;

an edge support ring in contact with a third portion of the flexible membrane overlying the edge control ring and rigidly coupled to the perforated plate, the edge support ring constraining motion of the edge control ring relative to the predetermined object; and a plate region overlying the plurality of perforations of the perforated plate for conducting fluid to and from the flexible membrane and restricting vertical motion of the perforated plate and flexible membrane.

2. The polishing carrier head of claim 1, wherein the edge support ring constrains motion of the edge control ring by preventing substantially all motion away from the predetermined object.

3. The polishing carrier head of claim 1, wherein the flexible membrane within the flab region forms one or more bellows.

4. The polishing carrier head of claim 1, wherein the predetermined object is a semiconductor wafer.

5. The polishing carrier head of claim 1 coupled to an assembly, the assembly further comprising:

a polishing surface for holding the predetermined object to be polished; and a platen underlying the polishing surface, the platen rotating the assembly.

6. The polishing carrier head of claim 1, wherein the edge control ring is overlying the flab region and location of the edge control ring is placed at a predetermined position to create a predetermined area for the flab region to control a polishing rate at an edge of the predetermined object.

7. The polishing carrier head of claim 1, wherein the flexible membrane further comprises a plurality of individual segments of flexible material placed substantially in a continuous pattern.

8. A polishing carrier head comprising:

a retaining ring for defining an area of a polishing pocket region used to polish a predetermined object, the retaining ring dampening external oscillatory energy;

an edge control ring positioned lateral to the retaining ring and separated from the retaining ring by a gap;

a perforated plate positioned lateral to the edge control ring, the perforated plate having a plurality of perforations for permitting fluid flow;

a flexible membrane overlying a portion of the retaining ring and the edge control ring and extends to a region in which a first portion of the flexible membrane overlies a second portion of the flexible membrane to form one or more bellows, the flexible membrane being exposed along a length thereof to make contact to a predetermined object for polishing the predetermined object;

an edge support ring in contact with a third portion of the flexible membrane overlying the edge control ring and rigidly coupled to the perforated plate, the edge support ring constraining motion of the edge control ring relative to the predetermined object; and a plate region overlying the plurality of perforations of the perforated plate for conducting fluid to and from the flexible membrane and restricting vertical motion of the perforated plate and flexible membrane.

9. The polishing carrier head of claim 8, wherein the edge support ring constrains motion of the edge control ring by preventing substantially all motion away from the predetermined object.

10. The polishing carrier head of claim 8, wherein the predetermined object is a semiconductor wafer.

11. The polishing carrier head of claim 8 coupled to an assembly, the assembly further comprising:

a polishing surface for holding the predetermined object to be polished; and a platen underlying the polishing surface, the platen rotating the assembly.

12. The polishing carrier head of claim 8, wherein the edge control ring is overlying the flab region and location of the edge control ring is placed at a predetermined position to create a predetermined area for the flab region to control a polishing rate at an edge of the predetermined object.

13. The polishing carrier head of claim 8, wherein the flexible membrane further comprises a plurality of individual segments of flexible material placed substantially in a continuous pattern.

14. A polishing carrier head comprising:

a retaining ring for defining an area of a polishing pocket region used to polish a predetermined object, the retaining ring dampening external oscillatory energy;

a perforated plate positioned lateral to the retaining ring, the perforated plate having a plurality of perforations for permitting fluid flow;

a flexible membrane having a first region overlying a portion of the retaining ring and the perforated plate and a second region in which a first portion of the flexible membrane overlies a second portion of the flexible membrane to form one or more bellows, the flexible membrane being exposed along a length thereof to make contact to a predetermined object for polishing the predetermined object;

an edge support ring in contact with the first region of the flexible membrane for clamping the first region of the flexible membrane to the perforated plate; and a plate region overlying the plurality of perforations of the perforated plate for conducting fluid to and from the flexible membrane and restricting vertical motion of the perforated plate and flexible membrane.

15. The polishing carrier head of claim 14, wherein the edge support ring constrains motion of the edge control ring by preventing substantially all motion away from the predetermined object.

16. The polishing carrier head of claim 14, wherein the predetermined object is a semiconductor wafer.

17. The polishing carrier head of claim 14 coupled to an assembly, the assembly further comprising:

a polishing surface for holding the predetermined object to be polished; and a platen underlying the polishing surface, the platen rotating the assembly.

18. The polishing carrier head of claim 14, wherein the edge control ring is overlying the flab region and location of the edge control ring is placed at a predetermined position to create a predetermined area for the flab region to control a polishing rate at an edge of the predetermined object.

19. The polishing carrier head of claim 14, wherein the flexible membrane further comprises a plurality of individual segments of flexible material placed substantially in a continuous pattern.

20. The polishing carrier head of claim 14, wherein the plate region further comprises a shaft region for said conducting fluid, the shaft region being rotated to spin the polishing carrier head.

* * * * *